US009353652B2

(12) United States Patent
Baindl

(10) Patent No.: US 9,353,652 B2
(45) Date of Patent: May 31, 2016

(54) MULTI-CYLINDER INTERNAL COMBUSTION ENGINE

(75) Inventor: Rupert Baindl, Geretsried (DE)

(73) Assignee: KJ IP Verwaltungs GmbH, Landsberg am Lech (DE)

( * ) Notice: Subject to any disclaimer, the term of this patent is extended or adjusted under 35 U.S.C. 154(b) by 97 days.

(21) Appl. No.: 13/699,546

(22) PCT Filed: May 24, 2011

(86) PCT No.: PCT/EP2011/058491
§ 371 (c)(1),
(2), (4) Date: Nov. 28, 2012

(87) PCT Pub. No.: WO2011/147840
PCT Pub. Date: Dec. 1, 2011

(65) Prior Publication Data

US 2013/0068190 A1 Mar. 21, 2013

(30) Foreign Application Priority Data

May 26, 2010 (DE) ..... 10 2010 021 613
May 26, 2010 (DE) ..... 10 2010 021 639
May 26, 2010 (DE) ..... 20 2010 007 271 U

(51) Int. Cl.
*F02F 1/42* (2006.01)
*F01L 1/34* (2006.01)
(Continued)

(52) U.S. Cl.
CPC . *F01L 1/34* (2013.01); *F02B 61/02* (2013.01); *F02B 75/221* (2013.01); *F02F 1/00* (2013.01); *F02F 7/0012* (2013.01)

(58) Field of Classification Search
CPC ..... F02F 1/00
USPC ..... 123/193.5, 54.4–54.8
See application file for complete search history.

(56) References Cited

U.S. PATENT DOCUMENTS 2,808,041 A 10/1957 Dolza
3,521,613 A * 7/1970 Celli ..... 123/195 R
(Continued)

FOREIGN PATENT DOCUMENTS

DE 10 2004 042 765 A1 6/2005
EP 1 146 219 A1 10/2001
(Continued)

OTHER PUBLICATIONS

Krueger, "Sechszylinder—Motoren Mit Kleinem V-Winkel", MTZ Motortechnische Zeitschrift, Bd. 51, Nr. 10, pp. 410-418 (1990) (English Abstract on p. 2 of document).
(Continued)

*Primary Examiner* — John Kwon
*Assistant Examiner* — Ruben Picon-Feliciano
(74) *Attorney, Agent, or Firm* — Fay Sharpe LLP

(57) ABSTRACT

A multi-cylinder internal combustion engine includes a cylinder arrangement which is a VR cylinder arrangement having rows of cylinders which are arranged in an offset manner and nested into each other. The crank drive acts crosswise onto a crankshaft and a common cylinder head is provided. The inlet channels in the cylinder head are arranged in an identical manner for all of the cylinders. Alternatively, the inlet channels of the one row of cylinders are disposed adjacent to one of two or three camshafts and the inlet channels of the other row of cylinders are disposed on the other side of the camshaft.

17 Claims, 7 Drawing Sheets

Figure 1:
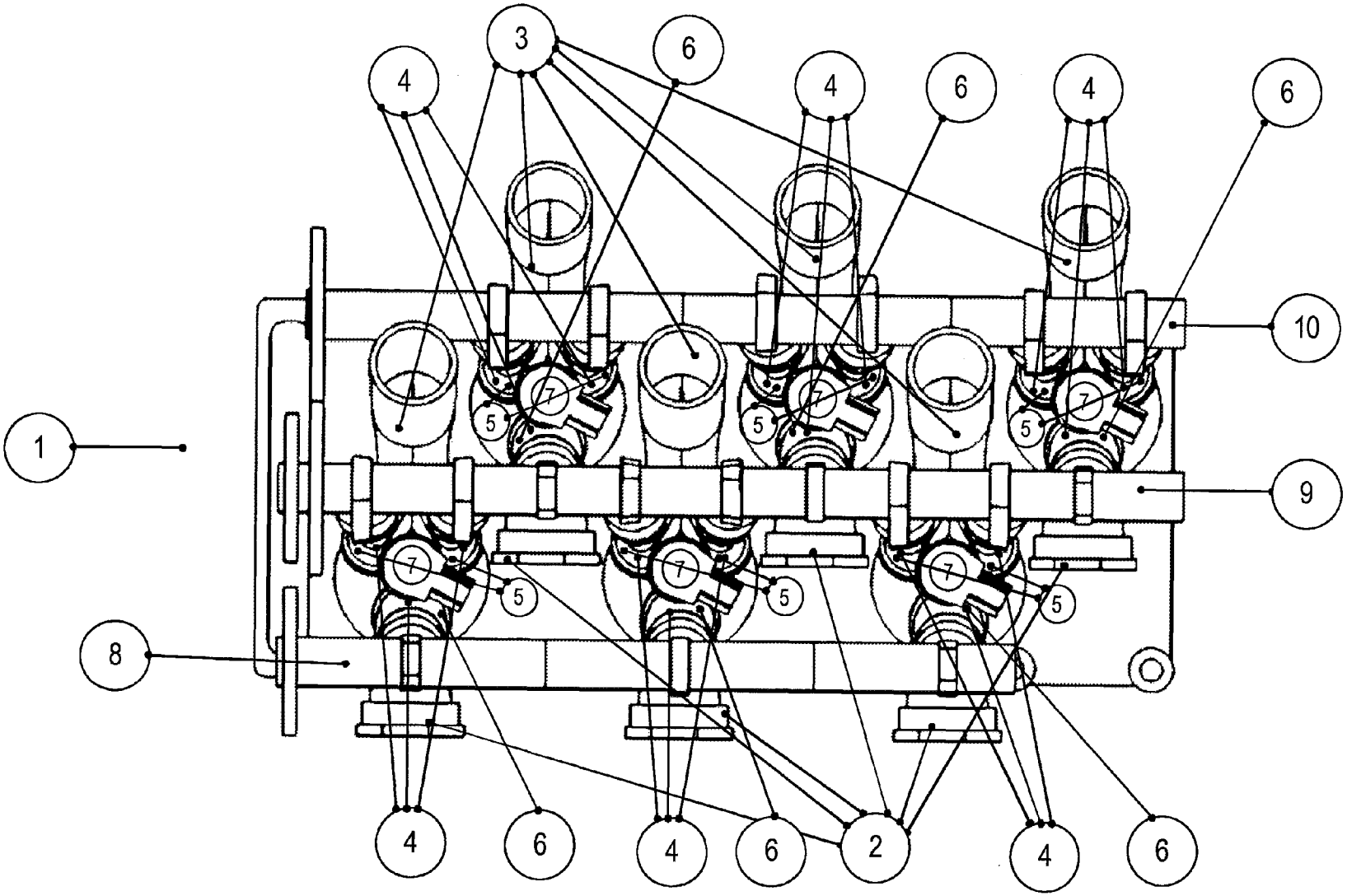

(51) Int. Cl.

| | |
|---|---|
| ***F02B 61/02*** | (2006.01) |
| ***F02B 75/22*** | (2006.01) |
| ***F02F 7/00*** | (2006.01) |
| ***F02F 1/00*** | (2006.01) |

(56) References Cited

U.S. PATENT DOCUMENTS

| | | | | |
|---|---|---|---|---|
| 4,787,342 | A | 11/1988 | Matsumori et al. | |
| 2006/0011153 | A1* | 1/2006 | Yamazaki | 123/54.4 |
| 2008/0168957 | A1* | 7/2008 | Neese | 123/54.4 |

FOREIGN PATENT DOCUMENTS

| | | | |
|---|---|---|---|
| EP | 1 553 280 | A1 | 7/2005 |
| GB | 860011 | A | 2/1961 |
| JP | 62-228645 | A | 10/1987 |

OTHER PUBLICATIONS

International Search Report of International Application No. PCT/EP2011/058491 dated Dec. 8, 2011 with English Translation.

International Preliminary Report on Patentability of International Application No. PCT/EP2011/058491 dated Dec. 6, 2012 with English Translation.

* cited by examiner

MULTI-CYLINDER INTERNAL COMBUSTION ENGINE

The invention relates to a compact multi-cylinder internal combustion engine.

EP 1 146 219 A1 already discloses the arrangement of gas ducts in a cylinder head of a VR engine. In this case, one cylinder head is used for two rows of cylinders. The two rows of cylinders are arranged in a staggered manner and pushed into each other and drive a common crankshaft in a restricted manner. Inlet and outlet ducts are largely routed horizontally in the cylinder head, i.e. transversely to the cylinder axis. All the outlet ducts open out on one side of the cylinder head, all the inlet ducts open out on the opposite side. The outlet ducts of the row of cylinders which is in each case offset to the rear are considerably longer than those of the ones at the front. The inlet ducts also have these differences in length, but are arranged in a mirrored manner. This duct arrangement is not suitable for engines with which high powers are to be achieved at high engine speeds, as is required for example with motorcycle engines. In particular, high power densities cannot be achieved with the very unequal inlet ducts.

The object of the invention is to provide a suitable cylinder head for a multi-cylinder internal combustion engine with a VR cylinder arrangement, with which high engine powers can be achieved.

The solution is provided by the multi-cylinder internal combustion engine according to Claim 1 or 2.

Advantageous configurations are specified in the dependent claims.

According to Claim 1, the object is achieved in that the cylinder head comprises a group of two, three, four or five gas ducts per cylinder, the group comprising at least one outlet duct and at least one inlet duct, and the geometric arrangement of the inlet ducts of one group being the same for all the cylinders.

The fact that the geometric arrangement of the inlet ducts is equal for all the groups means that the shape and profile of the inlet duct for one inlet valve, or of the inlet ducts in the case of several inlet valves, of a cylinder are the same for all the cylinders. This means in particular that this same geometric arrangement of the inlet ducts for the cylinders of the rear row of cylinders is the same as the geometric arrangement of the inlet ducts of the front row of cylinders. The inlet ducts for the cylinders of the rear row of cylinders can be aligned in the same direction as the inlet ducts of the front row of cylinders, but they can also be arranged in a mirrored manner with respect to each other. An identical arrangement for all the cylinders is also advantageous for the outlet ducts. With all the arrangements mentioned, it is also advantageous if the dimensions of the gas ducts of each cylinder are the same.

The use of the same geometric arrangement of the gas ducts for the front and rear rows of cylinders means that the same flow conditions can be achieved for all the cylinders, so uniform engine running is ensured over the entire speed range. With the use of identically shaped inlet ducts for all the cylinders, high engine power and the greatest possible synchronisation and smooth running of the engine are achieved.

Claim 2 describes a further solution according to the invention such that, when the crankshaft lies transversely (transverse installation), the inlet ducts of the rear row of cylinders are arranged behind the rear camshaft and the inlet ducts of the front row of cylinders are arranged in front of the rear camshaft or, when the crankshaft lies longitudinally (longitudinal installation), the inlet ducts of one row of cylinders are arranged to the left of an outer camshaft and the inlet ducts of the other row of cylinders are arranged to the right of the said camshaft.

The described arrangement of the inlet ducts on both sides of the inlet-side camshaft ensures that inlet ducts of the same length and shape are used, which are also relatively short, as a result of which a high engine power and the greatest possible synchronisation and smooth running of the engine are likewise achieved.

In a particularly advantageous development of the solutions according to the invention according to Claims 1 and 2, the engine comprises six cylinders.

A favourable development of the solution according to Claim 2 is also that, when there is a plurality of identical valves per cylinder, the inlet ducts and outlet ducts of one cylinder form a group and the geometrical arrangement or shape of the inlet ducts of one group is the same for all the cylinders.

It is also advantageous that the geometrical arrangement (shape) of the outlet ducts of one group is the same for all the cylinders.

In a further configuration, the internal combustion engine according to the invention comprises two, three, four or five valves per cylinder and one or two spark plugs per cylinder. Two, three or four camshafts can be installed per cylinder head. The gas ducts of the inlet valves of one cylinder can be combined to form one duct. The use of two inlet valves and one outlet valve per cylinder has proven particularly advantageous. If a plurality of outlet valves is used per cylinder, it is likewise favourable to combine the outlet ducts of one cylinder belonging to the individual valves to form one outlet duct.

In one configuration, the internal combustion engine is installed in a motorcycle with a transverse crankshaft, which is also referred to as a transverse installation. Then the cylinder head covers a front row of cylinders and a rear row of cylinders.

In another configuration, the internal combustion engine is installed in a motorcycle with a longitudinal crankshaft, which is referred to as a longitudinal installation. Then the cylinder head covers a left row of cylinders and a right row of cylinders.

If a plurality of inlet valves is advantageously provided per cylinder, that is, in a group, the ducts of one cylinder belonging to the inlet valves branch out from one common duct. If a plurality of outlet valves are provided, the outlet ducts of a cylinder belonging to the outlet valves merge to form one outlet duct.

Advantageously, the inlet ducts lead upwards and the outlet ducts run in a curved manner to one side or to both sides in a mirrored arrangement.

The forwardly curved outlet ducts of the rear row of cylinders are arranged between the forwardly curved outlet ducts of the front row of cylinders, the outlet duct of the outermost cylinder of the rear row of cylinders being arranged adjacently to the outlet duct of the cylinder of the front row of cylinders situated in front of it.

The cylinder head can be designed with one, two or three camshafts, the embodiments having two or three camshafts being particularly favourable. In the case of three camshafts, the central camshaft actuates the inlet valves of one row of cylinders and the outlet valves of the other row of cylinders. These valves are then arranged in an inclined manner with respect to each other. The front camshaft only actuates the outlet valves of the front row of cylinders, the rear camshaft only actuates the inlet valves of the rear row of cylinders. The valves are actuated directly by means of bucket tappets or else via rocker arms.

If two camshafts are used with transverse installation and identically aligned duct groups, the inlet ducts of the rear row of cylinders are arranged behind the rear camshaft and the inlet ducts of the front row of cylinders are arranged between the front and rear camshafts. In this case too, the valves are actuated directly by means of bucket tappets or via rocker arms.

If two camshafts are used with longitudinal installation, the inlet ducts of one row of cylinders lie to the left of one camshaft, the inlet ducts of the other row of cylinders lie to the right of the said camshaft.

If two camshafts are used with mirrored duct groups, all six inlet ducts are arranged between the two camshafts and lead upwards.

Alternatively, when three camshafts are used, the inlet ducts of the front row of cylinders can be arranged behind the central camshaft and in front of the rear camshaft, and the inlet ducts of the rear row of cylinders can be arranged behind the rear camshaft.

All the outlet ducts favourably open out of the cylinder head at the front, and the openings of the outlet ducts of the rear row of cylinders are offset to the rear in the longitudinal direction of the vehicle with respect to the those of the front row of cylinders.

It is also favourable that the duct dimensions of the gas ducts are the same for all the groups.

The alignment of the duct groups for the front and rear rows of cylinders can be the same but they can also be mirrored. In the case of mirrored arrangement of the groups, all the inlet ducts can open out in the top centre of the cylinder head and the outlet ducts can open out on both sides of the cylinder head. Conversely, all the outlet ducts can also run centrally and the inlet ducts can open out on both sides of the cylinder head.

If the outlet ducts run in a curved manner towards the front, then they run under the camshaft(s) situated in front of them. The outlet ducts are then situated under the central and front camshafts when three camshafts are used or only under the front camshaft when two camshafts are used.

The spark plugs are advantageously arranged centrally between the valves of the cylinders and lead upwards.

In a further embodiment, the internal combustion engine according to the invention comprises cylinders in the W arrangement, four rows of cylinders then being present with in each case one cylinder head for two rows of cylinders, two cylinder heads overall.

Exemplary embodiments of the multi-cylinder internal combustion engine according to the invention are presented in the figures described below. In particular, in the figures:

FIG. 1: shows a view of the cylinder head from above

Figure 2:
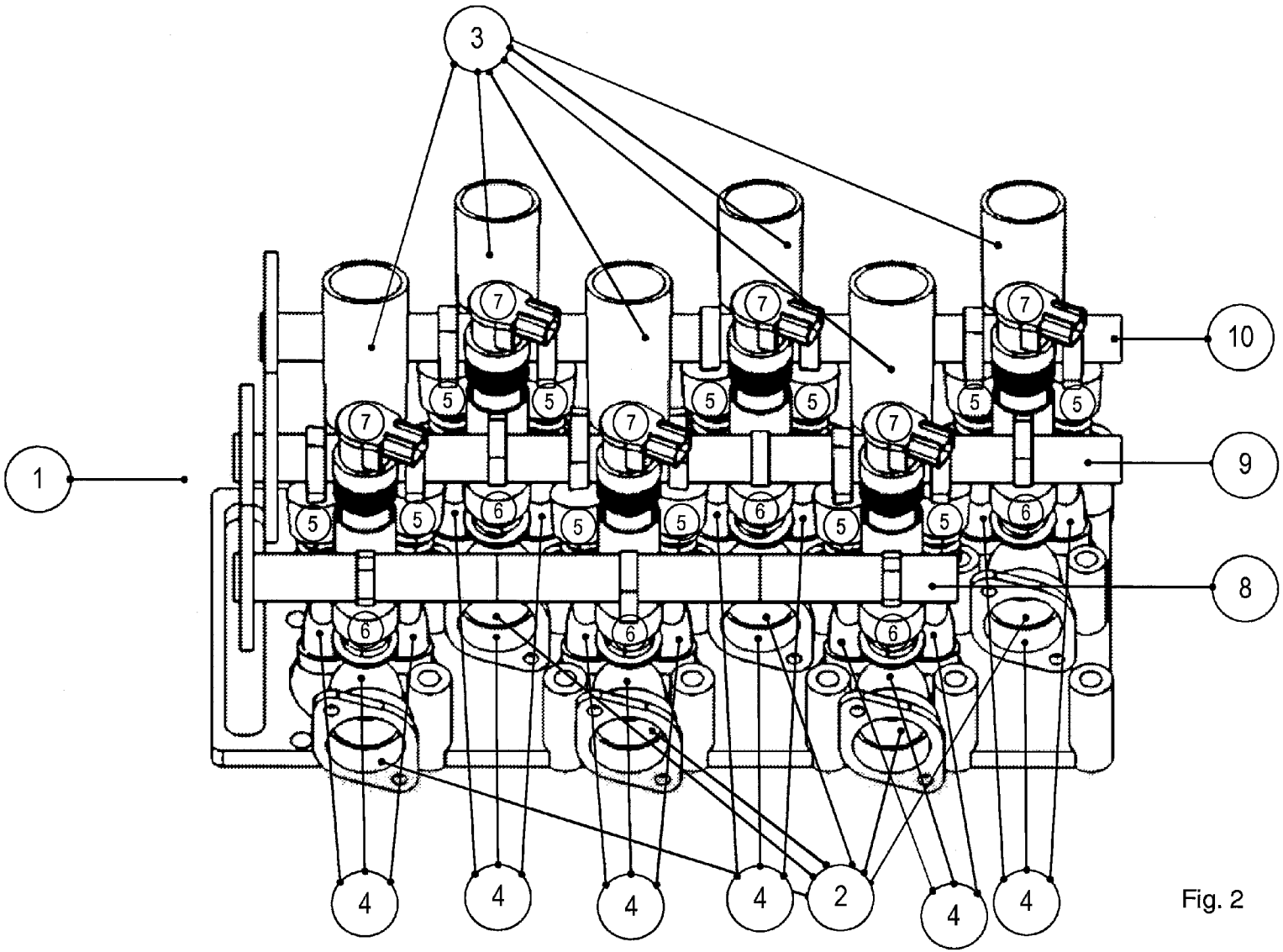

FIG. 2: shows a view of the cylinder head from the front and above

Figure 3:
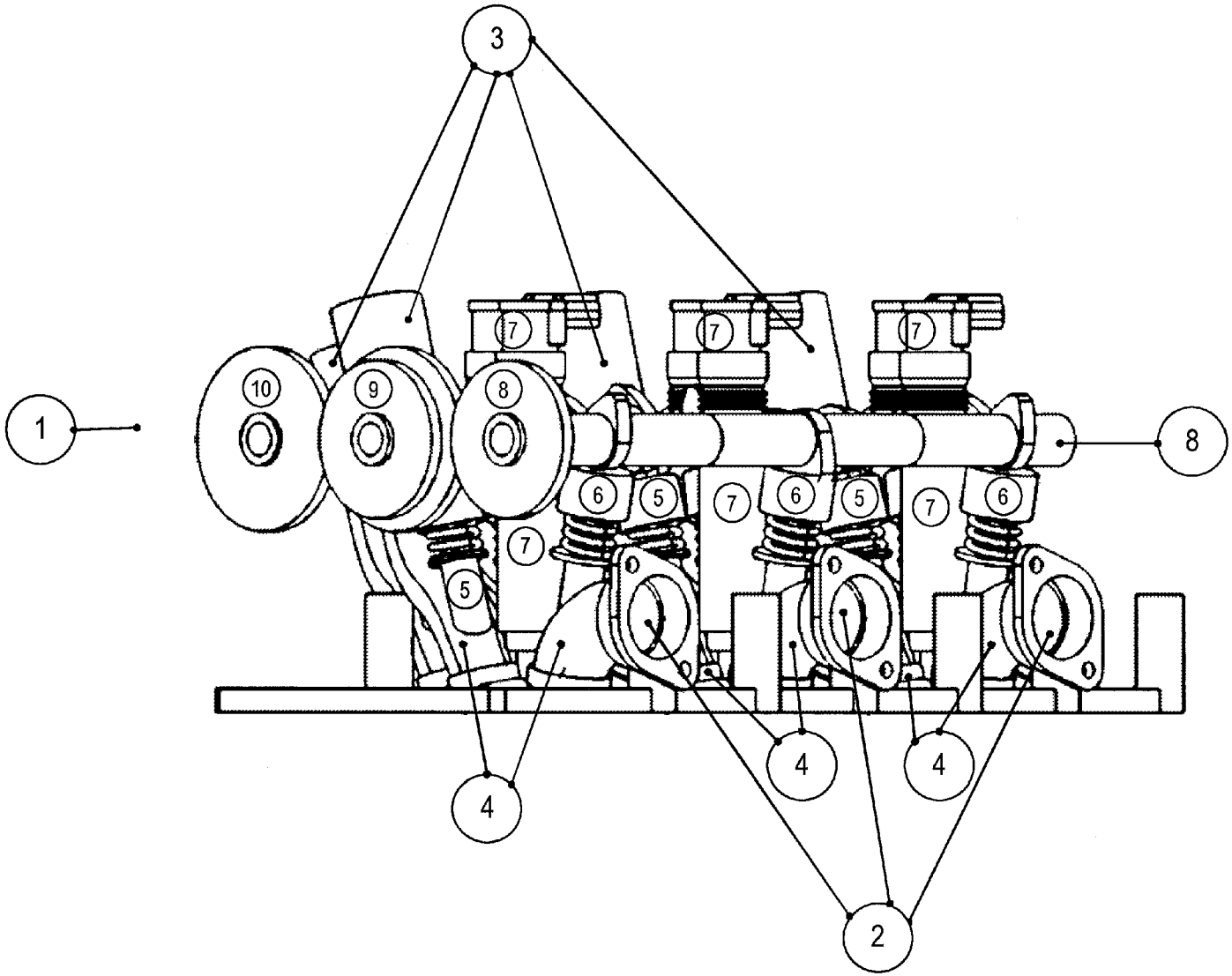

FIG. 3: shows a view of the cylinder head from the front and right

Figure 4:
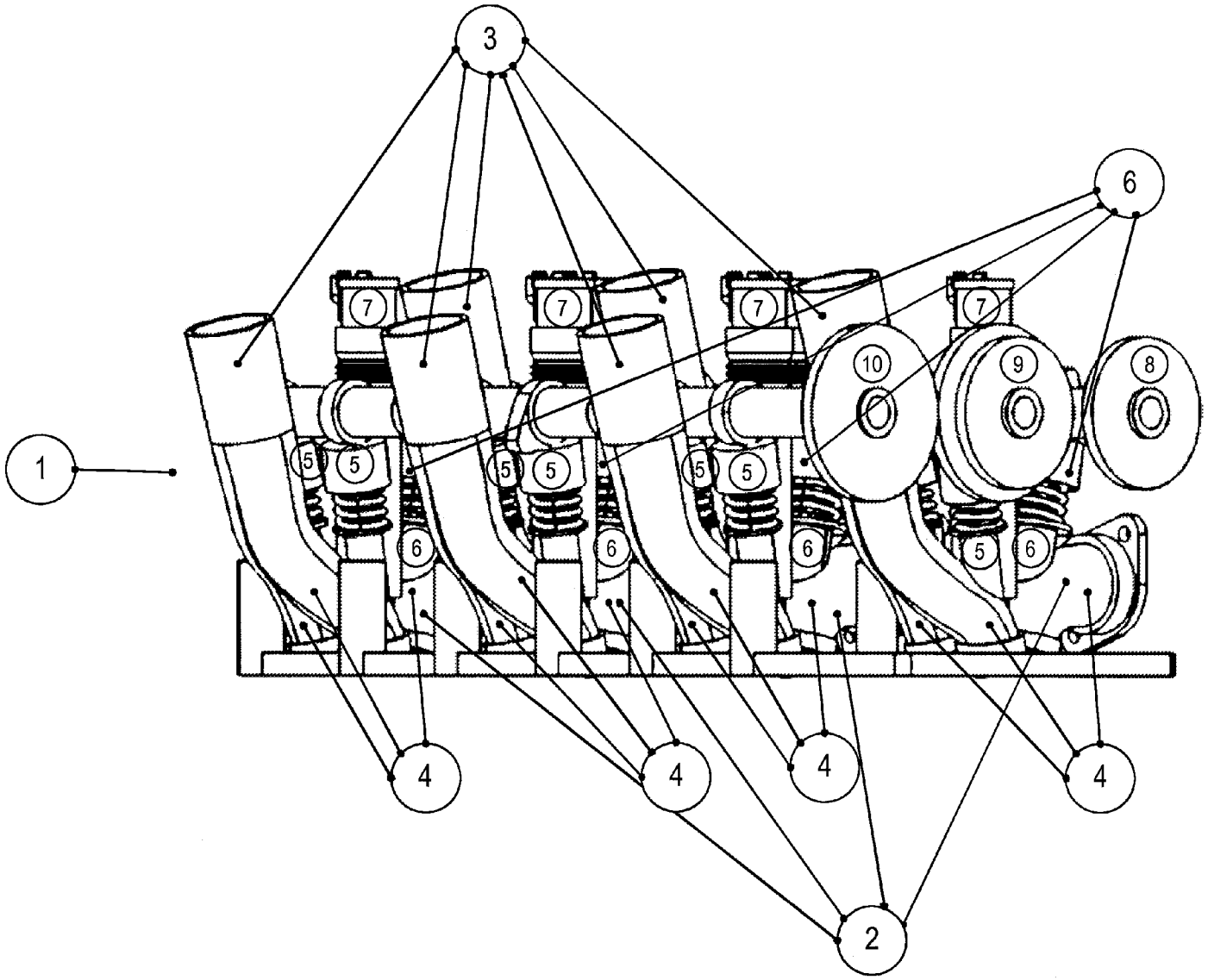

FIG. 4: shows a view of the cylinder head from the rear and right

Figure 5:
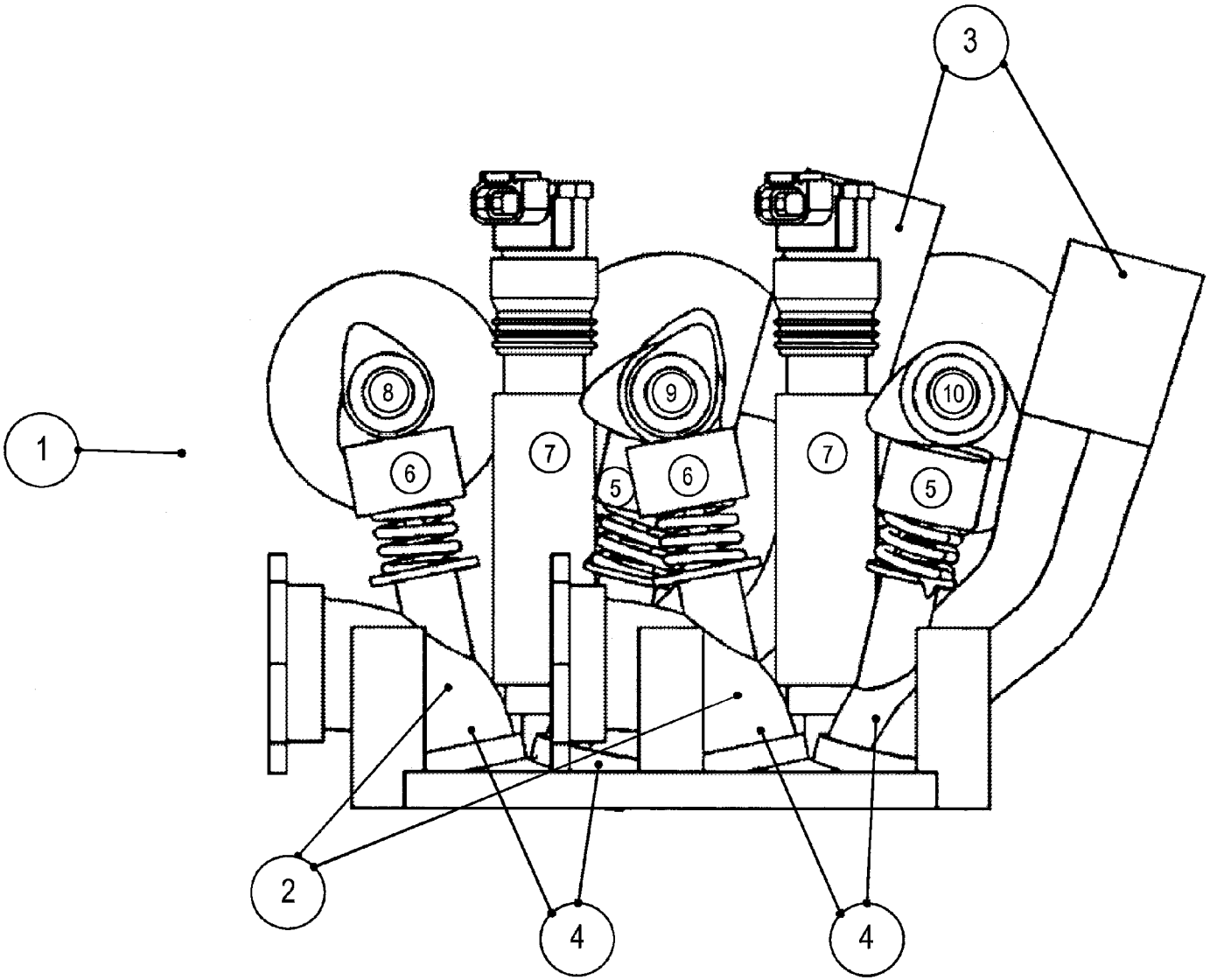

FIG. 5: shows a view of the cylinder head from the left

Figure 6:
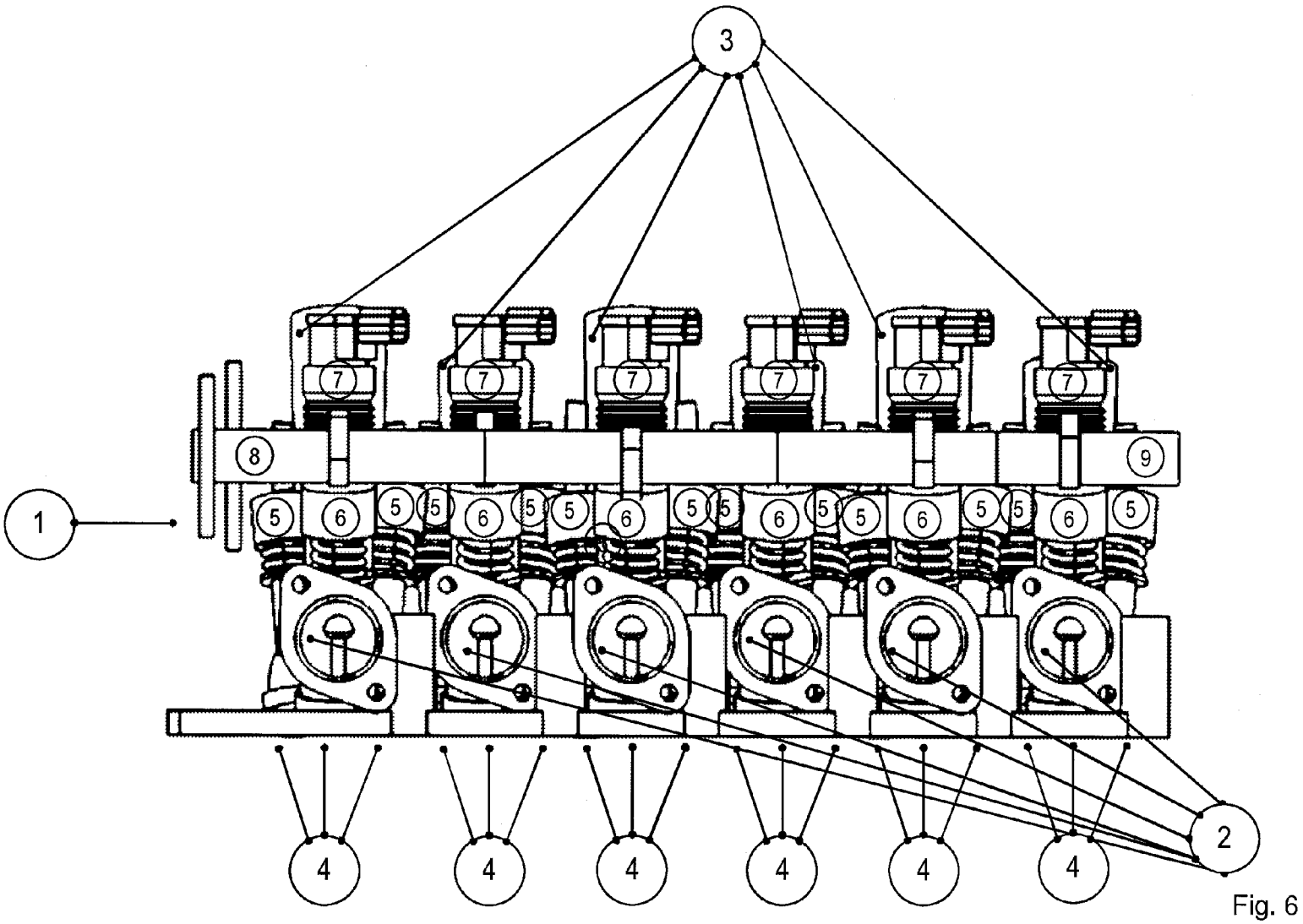

FIG. 6: shows a view of the cylinder head from the front

Figure 7:
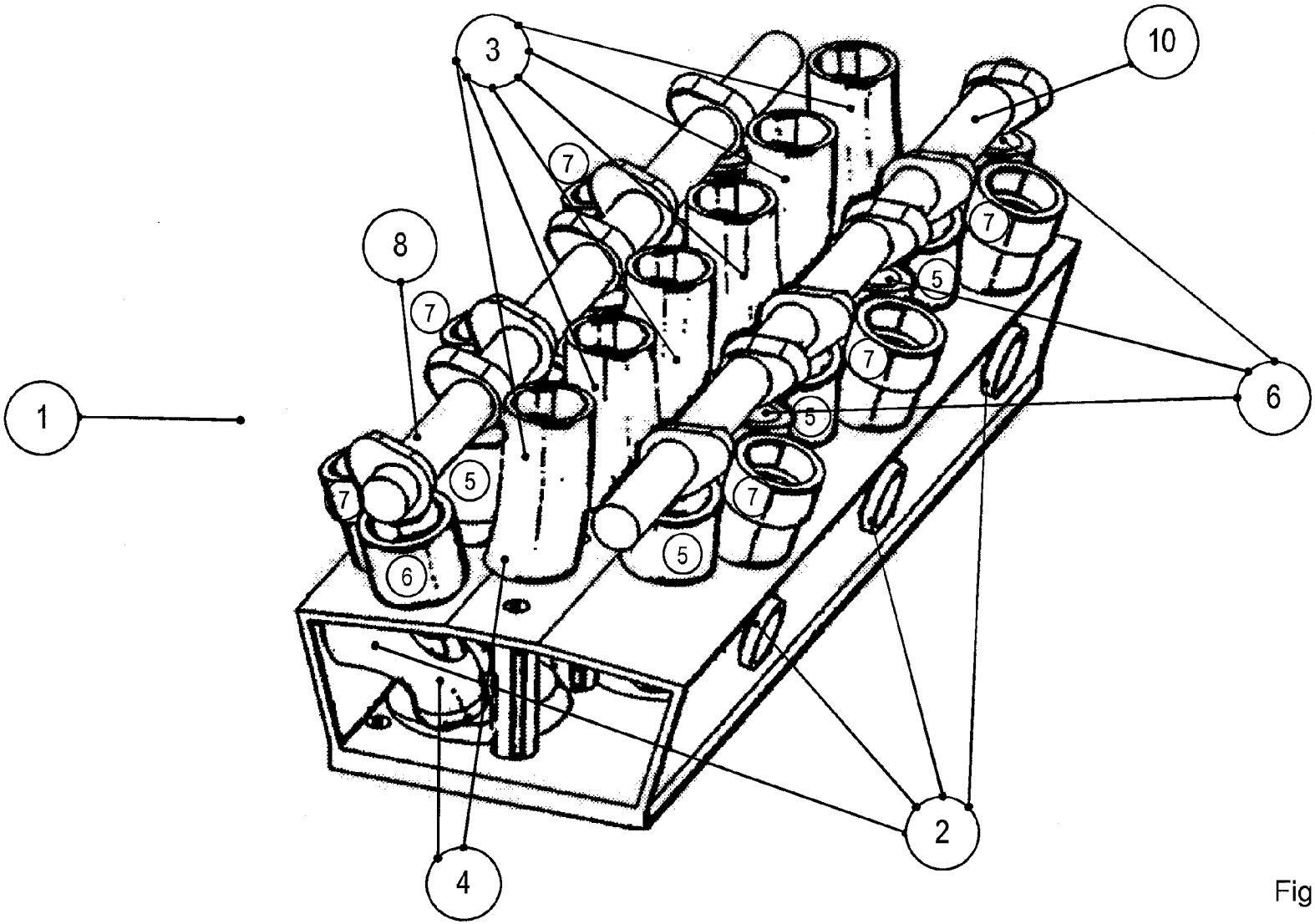

FIG. 7: shows a view of a cylinder head with 2 camshafts and outlet ducts opening on both sides The parts mentioned in the text are indicated in the figures by the following reference symbols:

LIST OF REFERENCE SYMBOLS

1 Cylinder head
2 Outlet duct
3 Inlet duct
4 Duct group
5 Inlet valve
6 Outlet valve
7 Spark plug
8 Front or left or right camshaft
9 Central camshaft
10 Rear or left or right camshaft Further details can be found in the drawings of possible exemplary embodiments of the motorcycle internal combustion engine according to the invention below.

FIG. 1 shows the view of an embodiment of the cylinder head 1 of the internal combustion engine according to the invention with six cylinders. The cylinder head 1 has three camshafts. The outlet ducts 2 run under the central camshaft and the one in front of it and open out towards the front or to one side of the cylinder head. All the outlet ducts 2 have the same geometry and the same dimensions and aligned towards the front, the outlet ducts 2 of the rear row of cylinders being offset to the rear and opening between or adjacently to the inlet valves 5 of the cylinders of the front row of cylinders. All the inlet ducts 3 likewise have the same geometry and dimensions and lead upwards and obliquely to the rear (in the case of transverse installation) or on the opposite side to the outlet duct openings (in the case of longitudinal installation). The inlet ducts 3 and the outlet duct 2 of a cylinder in each case form one duct group 4. The cylinder head 1 also comprises two inlet valves 5 and one outlet valve 6 per cylinder. In the figures, each duct group 4 includes two inlet ducts, which merge to form one, and one outlet duct, which is indicated in each case by three reference lines. The inlet ducts 3 belonging to the two inlet valves 5 of a cylinder merge to form one inlet duct 3 which leads upwards. The inlet ducts 3 of the rear row of cylinders lead upwards behind the rear camshaft 10, the inlet ducts 3 of the front row of cylinders leads upwards behind the central camshaft 9 and in front of the rear camshaft 10. The outlet ducts 2 of the rear row of cylinders are arranged under the central and front camshafts 8, 9 and lead forwards under these two camshafts. The common camshaft drive is arranged on one side. All the valves are actuated by the camshafts directly by means of bucket tappets. The spark plugs 7 are in each case arranged centrally between the two inlet valves 5 and the outlet valve 6. The two inlet valves 5 of a cylinder are arranged in an inclined manner with respect to each other, so the intersection point of their axes is in the combustion chamber of the cylinder.

FIG. 2 shows the view of the cylinder head 1 from the front and above. Each cylinder comprises two inlet valves 5 and one outlet valve 6, which are all actuated by the camshafts 8, 9, 10 by means of bucket tappets. The inlet ducts 3 of the two inlet valves 5 branch out from a common inlet duct 3 coming from above. The central camshaft 9 actuates the inlet valves 5 of the front row of cylinders and the outlet valves 6 of the rear row of cylinders. The spark plugs 7 are each arranged between the outlet valve 6 and the two inlet valves 5. FIG. 2 also shows the arrangement of the inlet ducts 3 of the rear row of cylinders behind the rear camshaft 10 and the arrangement of the inlet ducts 3 of the front row of cylinders between the rear and central camshafts. The front camshaft 8 only actuates the outlet valves 6 of the front row of cylinders.

FIG. 3 shows the curved profile of the outlet ducts 2 of the front row of cylinders. The valves are arranged obliquely and are actuated by the camshafts directly by means of bucket tappets.

FIG. 4 shows the s-shaped profile in the inlet ducts 3 and the branching thereof just above the valve seats of the inlet valves 5. The rear camshaft 10 actuates the inlet valves 5 of the rear row of cylinders.

FIG. 5 shows the cylinder head 1 as seen from the left. The outlet ducts 2 are curved towards the front by approx. 90 degrees. The inlet ducts 3 run in an s-shaped manner to the rear and upwards. The spark plugs 7 are arranged perpendicularly. The central camshaft 9 actuates the inlet valves 5 of the front row of cylinders and the outlet valves 6 of the rear row of cylinders. The valves actuated by the central camshaft 9 are inclined with respect to each other.

FIG. 6 shows the view of the cylinder head from the front. All the outlet ducts 2 are arranged at the same height. All the camshafts 8, 9, 10 are also arranged at the same height, therefore only the front camshaft 8 can be seen completely in FIG. 6. From the camshaft 9, only the end of the central camshaft 9 which projects can be seen on the right-hand side in the figure.

FIG. 7 shows a further embodiment of the cylinder head 1 according to the invention for a VR6 engine. The cylinder head comprises two camshafts 8, 10. The outlet ducts 2 open out on both sides of the cylinder head 1: Three outlet ducts 2 open out on the left, three outlet ducts 2 open out on the right. All six inlet ducts 3 are arranged between the two camshafts 8, 10 are lead upwards. The outlet duct 2 and the inlet duct 3 of a cylinder form one duct group 4, which comprises only two ducts in this exemplary embodiment. The duct groups 4 of one row of cylinders are arranged in a mirror-inverted manner with respect to the duct groups 4 of the other row of cylinders. The duct dimensions of all the duct groups are the same. The camshafts 8, 10 actuate the associated valves directly by means of bucket tappets. The spark plug 7 is in each case arranged laterally between the inlet and outlet valves.

The invention claimed is:

1. A multi-cylinder internal combustion engine, the cylinder arrangement of which is a VR cylinder arrangement with rows of cylinders which are arranged in a staggered manner and pushed into each other, the crank drive acting on the crankshaft in a restricted manner so that the two planes which are formed by the cylinder axes of each row of cylinders intersect below the crankshaft axis, a common cylinder head being present in each case for two rows of cylinders, wherein the common cylinder head comprises three camshafts; and wherein the cylinder head comprises a group of two, three or four gas ducts per cylinder, the group comprising at least one outlet duct and at least one inlet duct, and the geometric arrangement of the inlet ducts of one group being the same for all the cylinders, such that the inlet ducts all have the same length and the same shape, wherein the inlet ducts open out of the cylinder head and lead upwards, wherein the intakes of the inlet ducts of one row of cylinders are located above the three camshafts and between a pair of two of the three camshafts, and wherein the outlets of the outlet ducts of the other row of cylinders are located between another pair of two of the three camshafts.

2. A multi-cylinder internal combustion engine, the cylinder arrangement of which is a VR cylinder arrangement with rows of cylinders which are arranged in a staggered manner and pushed into each other, the crank drive acting on the crankshaft in a restricted manner so that the two planes which are formed by the cylinder axes of each row of cylinders intersect below the crankshaft axis, a common cylinder head being present in each case for two rows of cylinders, and the common cylinder head having three camshafts, namely two outer camshafts and a middle camshaft, the engine including one or more inlet ducts for the cylinders and one or more outlet ducts for the cylinders, wherein the inlet ducts open up out of the cylinder head and lead upwards and wherein at least some of the inlet ducts are located between the camshafts, wherein the inlet ducts of both rows of cylinders have the same length and the same shape, wherein the intakes of the inlet ducts of a first row of cylinders are arranged between the first outer camshaft and the middle camshaft and the outlets of the outlet ducts of the first row of cylinders are arranged on a side of the second outer camshaft opposite to the middle camshaft, and wherein the intakes of the inlet ducts of a second row of cylinders are arranged on a side of the first outer camshaft opposite to the middle camshaft and the outlets of the outlet ducts of the second row of cylinders are arranged between the middle camshaft and the second outer camshaft.

3. The multi-cylinder internal combustion engine according to claim 2, wherein the inlet duct or the inlet ducts and the outlet duct or the outlet ducts of one cylinder form a group and the geometrical arrangement of the one inlet duct or the inlet ducts of one group is the same for all the cylinders.

4. The multi-cylinder internal combustion engine according to claim 1, wherein the geometrical arrangement of the outlet ducts of one group is the same for all the cylinders.

5. The multi-cylinder internal combustion engine according to claim 1, wherein the internal combustion engine is installed in a motorcycle with a transverse crankshaft.

6. The multi-cylinder internal combustion engine according to claim 1, wherein the internal combustion engine is installed in a motorcycle with a longitudinal crankshaft.

7. The multi-cylinder internal combustion engine according to claim 1, wherein in one group the ducts belonging to the inlet valves originate from one common duct and/or the outlet ducts belonging to the outlet valves merge to form one outlet duct.

8. The multi-cylinder internal combustion engine according to claim 1, wherein the outlet ducts run in a curved manner towards the front or rear.

9. The multi-cylinder internal combustion engine according to claim 8, wherein forwardly curved outlet ducts of a rear row of cylinders are also arranged between forwardly curved outlet ducts of a front row of cylinders, the outlet duct of an outermost cylinder of the rear row of cylinders being arranged adjacently to the outlet duct of a cylinder of the front row of cylinders situated in front of it.

10. The multi-cylinder internal combustion engine according to claim 1, wherein the three camshafts comprise a central camshaft and front and rear camshafts, wherein the central camshaft actuates the inlet valves of one row of cylinders and the outlet valves of the other row of cylinders.

11. The multi-cylinder internal combustion engine according to claim 10, wherein the inlet ducts of the rear row of cylinders are arranged behind the rear camshaft.

12. The multi-cylinder internal combustion engine according to claim 10, wherein the inlet ducts of the front row of cylinders are arranged between the front and the rear camshaft.

13. The multi-cylinder internal combustion engine according to claim 10, wherein the inlet ducts of the front row of cylinders are arranged behind the central camshaft and in front of the rear camshaft and the inlet of the rear row of cylinders are arranged behind the rear camshaft.

14. The multi-cylinder internal combustion engine according to claim 1, wherein all the outlet ducts open out of the cylinder head to one side, and the openings of the outlet ducts of the rear row of cylinders are offset to the rear with respect to those of the front row of cylinders.

15. The multi-cylinder internal combustion engine according to claim 1, wherein the duct dimensions of the gas ducts are the same for all the groups.

16. The multi-cylinder internal combustion engine according to claim 1, wherein all the groups for the front and rear rows of cylinders are aligned the same.

17. The multi-cylinder internal combustion engine according to claim 8, wherein the curved outlet ducts run under at least one camshaft of the three camshafts.

* * * * *